US011402795B2

(12) United States Patent
Kim et al.

(10) Patent No.: US 11,402,795 B2
(45) Date of Patent: Aug. 2, 2022

(54) REPLACEABLE CARTRIDGE WITH DRIVEN COUPLER

(71) Applicant: Hewlett-Packard Development Company, L.P., Spring, TX (US)

(72) Inventors: Jinhong Kim, Suwon (KR); Jinsam Park, Suwon (KR); Youngchae Kim, Pangyo (KR); Yonghun Kim, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/417,167

(22) PCT Filed: Jan. 6, 2020

(86) PCT No.: PCT/US2020/012333

§ 371 (c)(1),
(2) Date: Jun. 22, 2021

(87) PCT Pub. No.: WO2021/040776

PCT Pub. Date: Mar. 4, 2021

(65) Prior Publication Data

US 2022/0179355 A1 Jun. 9, 2022

(30) Foreign Application Priority Data

Aug. 26, 2019 (KR) ..... 10-2019-0104429

(51) Int. Cl.
*G03G 21/16* (2006.01)
*G03G 15/00* (2006.01)
*G03G 21/18* (2006.01)

(52) U.S. Cl.
CPC ..... *G03G 21/1647* (2013.01); *G03G 15/757* (2013.01); *G03G 21/186* (2013.01); *G03G 21/1864* (2013.01)

(58) Field of Classification Search
CPC ..... G03G 21/1647; G03G 15/757; G03G 21/186; G03G 21/1864
See application file for complete search history.

(56) References Cited

U.S. PATENT DOCUMENTS 4,439,257 A 3/1984 Sato et al.
6,879,789 B2 4/2005 Yamada et al.
(Continued)

FOREIGN PATENT DOCUMENTS

JP 2000310908 11/2000
JP 2013190457 9/2013
RU 2004126181 A 2/2006

*Primary Examiner* — Sandra Brase
(74) *Attorney, Agent, or Firm* — HP Inc. Patent Department

(57) ABSTRACT

An example cartridge may be detachably attached to a main body of an image forming apparatus. The cartridge includes a rotation member and a driven coupler to receive a rotation force to rotate the rotation member. The driven coupler includes a power transmission member connected to the rotation member, an extension member extending from the power transmission member and including an outer diameter portion, a hollow portion, and a through portion, a protrusion member located at the hollow portion and movable between a protrusion position for receiving the rotation force and a retreat position, a switching member inserted into the hollow portion and movable between first and second positions for locating the protrusion member at the protrusion position and the retreat position, respectively, and an elastic member to apply an elastic force to the switching member in a direction for location at the second position.

15 Claims, 10 Drawing Sheets

(56) References Cited

U.S. PATENT DOCUMENTS

| | | | | |
|---|---|---|---|---|
| 7,512,362 | B2 | 3/2009 | Park | |
| 8,160,471 | B2 | 4/2012 | Jimba et al. | |
| 2011/0182619 | A1 | 7/2011 | Batori et al. | |
| 2013/0279938 | A1 | 10/2013 | Miyabe et al. | |
| 2016/0282798 | A1* | 9/2016 | Matsuoka | G03G 15/757 |
| 2017/0146951 | A1* | 5/2017 | Yan | G03G 21/186 |

* cited by examiner

REPLACEABLE CARTRIDGE WITH DRIVEN COUPLER

BACKGROUND

An electrophotographic image forming apparatus may form a visible toner image on a photoconductor by supplying toner to an electrostatic latent image formed on the photoconductor, transfer the toner image through an intermediate transfer medium or directly to a printing medium, and fix the transferred toner image to the printing medium.

An image forming apparatus may include a cartridge detachably attached to a main body. The cartridge may be implemented in various forms. For example, the cartridge may include a toner cartridge containing toner, a photosensitive cartridge including a photosensitive drum, a development cartridge including a developing roller, or an imaging cartridge including a photosensitive drum and a developing roller. The cartridge may be replaced by a user, such as when the cartridge reaches the end of its life. The cartridge may include one or more rotation members and a driven coupler that receives a rotation force from the main body to rotate the rotation members.

DETAILED DESCRIPTION OF EXAMPLES

Figure 1:
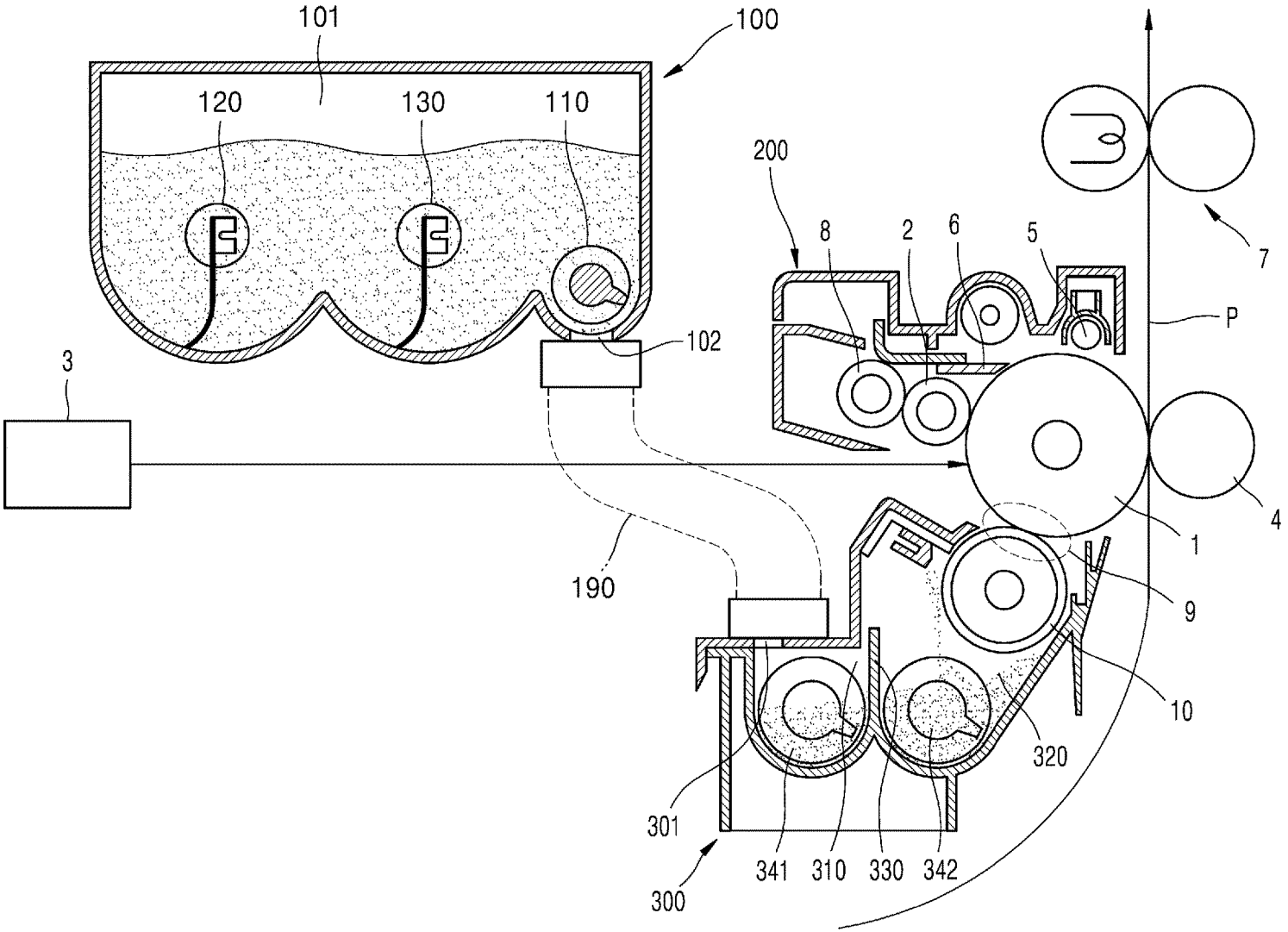
FIG. 1 is a configuration diagram of an electrophotographic image forming apparatus according to an example.

Hereinafter, various examples will be described with reference to the drawings. Like reference numerals in the specification and the drawings denote like elements, and thus their descriptions will be omitted.

FIG. 1 is a configuration diagram of an electrophotographic image forming apparatus according to an example. The image forming apparatus of the present example may be a monochrome image forming apparatus using a two-component developer including a toner and a magnetic carrier. The color of the toner is, for example, black.

Referring to FIG. 1, the image forming apparatus may include an optical scanner 3, a photosensitive unit 200, a developing unit 300, a transfer unit, and a fixing unit 7.

The photosensitive unit 200 may include a photosensitive drum 1 that may be rotated. The photosensitive drum 1 may be an example of a photoconductor on which an electrostatic latent image is formed. The photosensitive drum 1 may include a cylindrical metal pipe and a photosensitive layer having photoconductivity formed on an outer circumference of the metal pipe. The photosensitive unit 200 may further include a charging roller 2. The charging roller 2 may be an example of a charger for charging the surface of the photosensitive drum 1 to have a uniform surface electric potential. The charging roller 2 may be rotated in contact with the photosensitive drum 1, and a charging bias voltage may be applied to the charging roller 2. As the charger, a corona charger may be used to charge the surface of the photosensitive drum 1 by applying a bias voltage between a plate electrode and a wire electrode to generate a corona discharge. The photosensitive unit 200 may further include a cleaning roller 8 for removing foreign substances on the surface of the charging roller 2. The photosensitive unit 200 may further include a cleaning blade 6 for removing a residual toner from the surface of the photosensitive drum 1 after a transfer process described below. A static eliminator 5 for removing a residual electric potential on the photosensitive drum 1 may be arranged on an upstream side of the cleaning blade 6 based on the rotation direction of the photosensitive drum 1. The static eliminator 5 may irradiate light, for example, to the surface of the photosensitive drum 1.

The optical scanner 3 may irradiate light corresponding to image information to the charged surface of the photosensitive drum 1 to form an electrostatic latent image thereon. As the optical scanner 3, for example, a laser scanning unit (LSU), may be used to scan the photosensitive drum 1 by deflecting light irradiated from a laser diode in a main scanning direction by using a polygon mirror. A bar-type optical scanner in which a plurality of light emitting devices such as light emitting diodes (LEDs) turned on/off in response to image information are arranged in the main scanning direction may be used as the optical scanner 3.

The developing unit 300 may mix and agitate a toner and a carrier and supply toner to an electrostatic latent image formed on the photosensitive drum 1 to form a visible toner image on the surface of the photosensitive drum 1. The developing unit 300 may include a developing roller 10 for supplying toner to the photosensitive drum 1 while being rotated.

The internal space of the developing unit 300 may be divided into an agitating chamber 310 and a developing chamber 320 that may be parallel to each other. A first agitator 341 may be installed in the agitating chamber 310. The developing roller 10 and a second agitator 342 may be installed in the developing chamber 320. The agitating chamber 310 and the developing chamber 320 may be divided from each other by a partition 330 extending in an axial direction of the developing roller 10. An opening (not illustrated) may be provided at each of both end portions in a lengthwise direction of the partition 330, that is, in the axial direction of the developing roller 10. The agitating chamber 310 and the developing chamber 320 may be connected to each other by the opening. Each of the first and second agitators 341 and 342 may be, for example, an auger including a shaft extending in the axial direction of the developing roller 10 and a spiral blade formed on an outer circumference of the shaft. When the first agitator 341 is rotated, the developer in the agitating chamber 310 may be conveyed by the first agitator 341 in the axial direction (first direction) and may be conveyed to the developing chamber 320 through the opening provided near one end portion of the partition 330. The developer in the developing chamber 320 may be conveyed by the second agitator 342 in the second direction opposite to the first direction and may be conveyed to the agitating chamber 310 through the opening provided near the other end portion of the partition 330. Accordingly, the developer may be circulated along the agitating chamber 310 and the developing chamber 320 and may be supplied to the developing roller 10 located in the developing chamber 320, in a circulation process.

The developing roller 10 may convey the developer including the toner and the carrier to a developing region 9 facing the photosensitive drum 1. The toner may be attached to the carrier by an electrostatic force, and the carrier may be attached to the surface of the developing roller 10 by a magnetic force. Accordingly, a developer layer may be formed on the surface of the developing roller 10. The developing roller 10 may be located to be spaced apart from the photosensitive drum 1 by a developing gap. The developing gap may be set to about tens to hundreds of micrometers. Toner may be moved from the developing roller 10 to the photosensitive drum 1 by a developing bias voltage applied between the developing roller 10 and the photosensitive drum 1, and a visible toner image may be formed on the surface of the photosensitive drum 1.

A transfer roller 4 may be an example of the transfer unit for transferring a toner image formed on the photosensitive drum 1 to a printing medium P. The transfer roller 4 may face the photosensitive drum 1 to form a transfer nip, and a transfer bias voltage may be applied to the transfer roller 4. The toner image developed on the surface of the photosensitive drum 1 may be transferred to the printing medium P by a transfer electric field formed between the photosensitive drum 1 and the transfer roller 4 by the transfer bias voltage. A corona transfer unit using a corona discharge may be used instead of the transfer roller 4.

The toner image transferred to the printing medium P may be attached to the printing medium P by an electrostatic force. The fixing unit 7 may apply heat and pressure to fix the toner image to the printing medium P.

When the toner in the developing unit 300 is consumed, toner may be supplied from a toner cartridge 100 to the developing unit 300. The toner cartridge 100 may include a toner container 101 containing toner and a conveying member for conveying the toner of the toner container 101 to a toner outlet 102. A toner supply member 190 may connect the toner outlet 102 to a toner supply hole 301 of the developing unit 300.

As an example, the conveying member may include a toner discharge member 110 in the form of a rotating auger for conveying a toner in a widthwise direction and paddle members 120 and 130 for conveying the toner in the toner container 101 toward the toner discharge member 110. The widthwise direction may be the axial direction of the toner discharge member 110. When the paddle members 120 and 130 are rotated, toner in the toner container 101 may be conveyed toward the toner discharge member 110. The toner discharge member 110 may convey toner to the toner outlet 102. Although not illustrated in the drawings, the toner cartridge 100 may be provided with a shutter for selectively opening/closing the toner outlet 102.

The image forming apparatus may include one or more detachable cartridges. The cartridge may include one or more rotation members.

Figure 2:
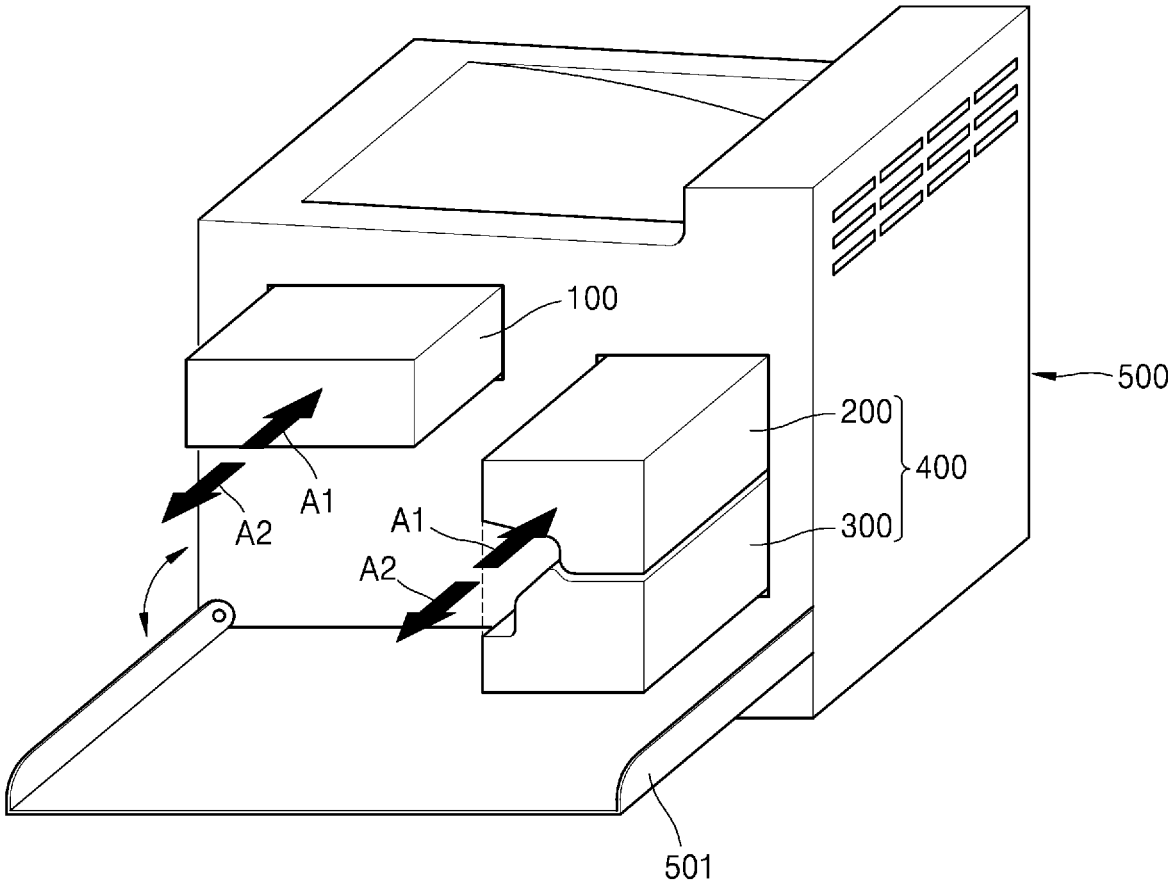
FIG. 2 is a perspective view of an image forming apparatus, illustrating a state of replacing a cartridge according to an example.

FIG. 2 is a perspective view of an image forming apparatus, illustrating a state of replacing a cartridge according to an example.

Referring to FIG. 2, a door 501 may be opened to open a portion of a main body 500 of the image forming apparatus, and the cartridge may be attached/detached to/from the main body 500. The cartridge may be slid in a mounting direction A1 and a removal direction A2 to be mounted/removed to/from the main body 500. The mounting direction A1 and the removal direction A2 may be the axial direction of a rotation member provided in the cartridge.

For example, the photosensitive unit 200 may be a cartridge (i.e., a photosensitive cartridge) that may be replaced when the life of the photosensitive drum 1 ends. The developing unit 300 may be a cartridge (i.e., a development cartridge) that may be replaced when the life of one or more internal members thereof ends. The photosensitive unit 200 and the developing unit 300 may be an integrally replaceable cartridge (i.e., an imaging cartridge 400). The toner cartridge 100 may be a cartridge (i.e., a toner cartridge) that may be replaced when toner contained therein is consumed.

When the cartridge is mounted in the main body 500, the cartridge may be connected to a motor by a coupling structure and may receive a rotation force from the motor to rotate the rotation members of the cartridge, for example, the photosensitive drum 1 and the charging roller 2 of the photosensitive unit 200, the developing roller 10 and the first and second agitators 341 and 342 of the developing unit 300, or the toner discharge member 110 and the paddle members 120 and 130 of the toner cartridge 100.

The coupling structure may vary according to various examples. A gear-gear coupling structure, a complementary concavo-convex coupling structure, or the like may be used as the coupling structure. The coupling structure may include a driving coupler provided at the main body 500 and a driven coupler provided at the cartridge. The driven coupler of the cartridge may be exposed outside the cartridge before the cartridge is mounted in the main body 500 or when the cartridge is detached from the main body 500. In the process of handling the cartridge, the driven coupler may be damaged by an external impact.

In order to reduce the size of the image forming apparatus, the size of the driven coupler provided at the cartridge also should be reduced. However, when the size of the driven coupler is reduced, because the size of a rotation force transmission element engaging with the driving coupler to directly receive the rotation force of the driving coupler may also be reduced, it may be difficult to obtain stable transmission of the rotation force. As the size of the rotation force transmission element increases, the transmission of the rotation force from the driving coupler to the driven coupler may be more stable. However, as the size of the rotation force transmission element increases, the risk of the rotation force transmission element being damaged by an external impact may increase. Thus, it is desirable to use a driven coupler capable of being miniaturized while stably transmitting the rotation force and reducing the risk of damage by external impact.

Figure 3:
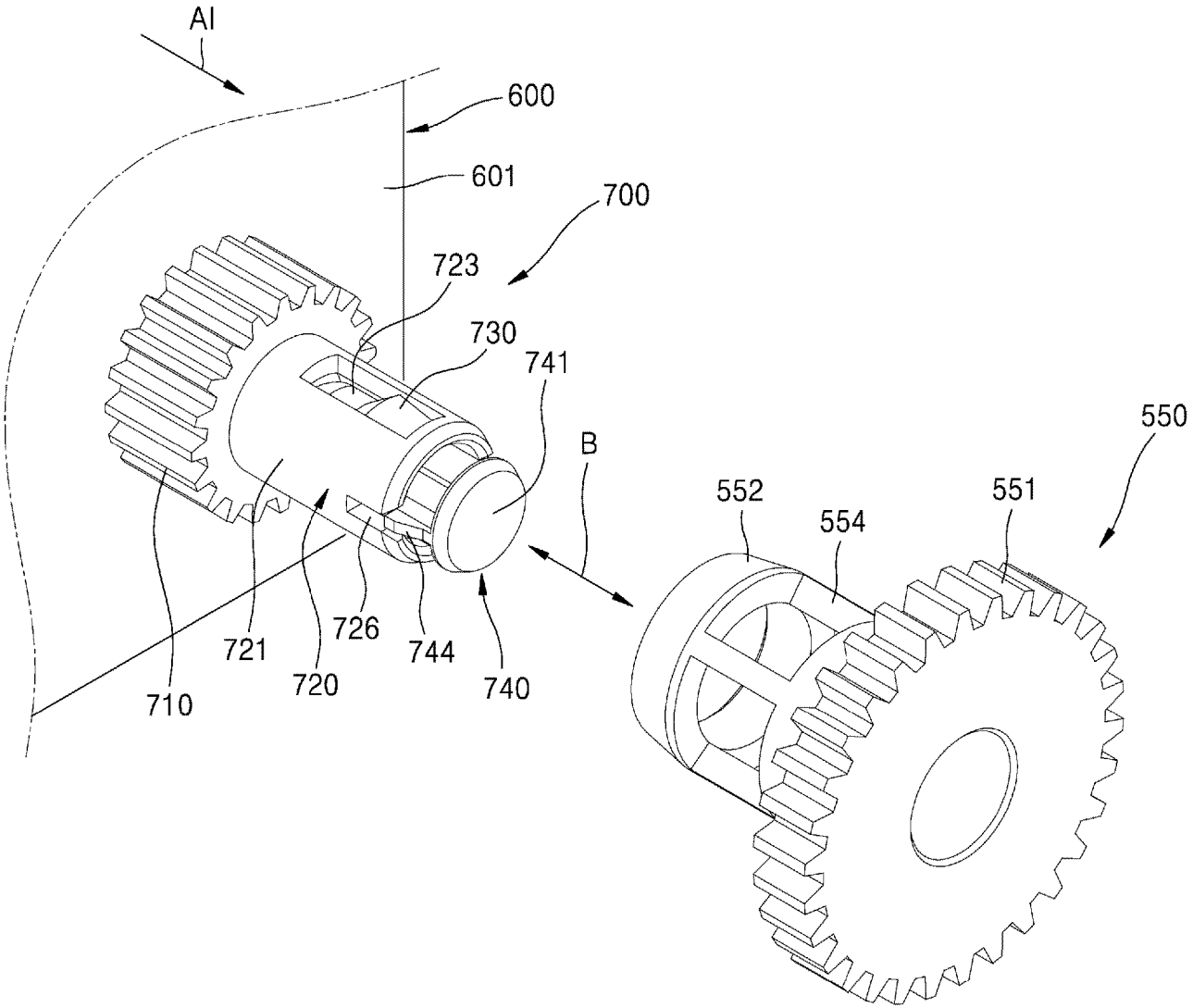
FIG. 3 is a perspective view of a coupling structure according to an example.
Figure 4:
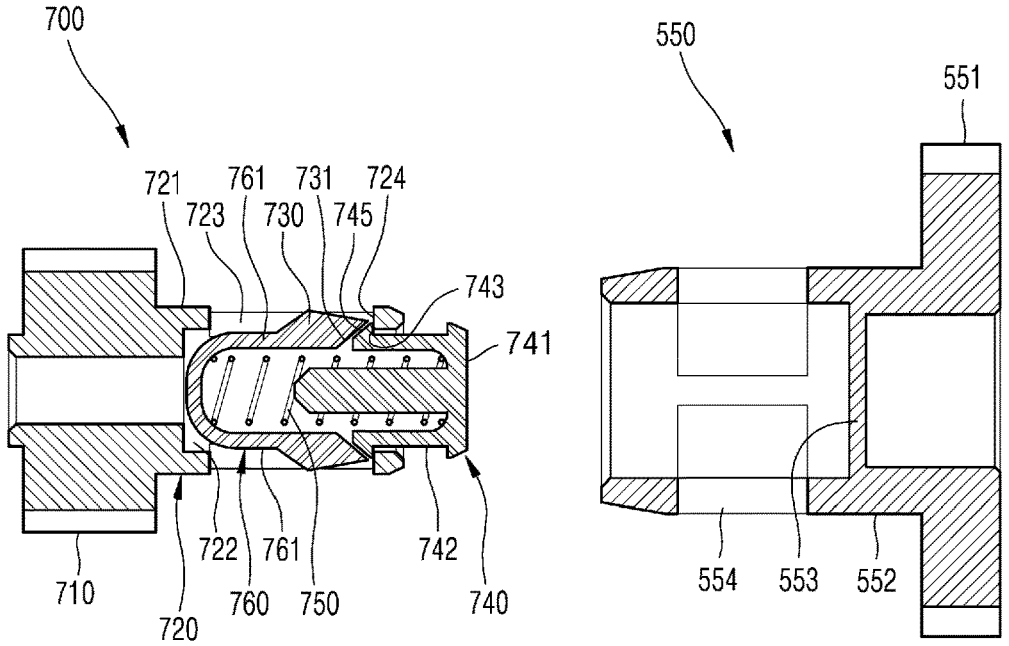
FIG. 4 is a cross-sectional view of a driving coupler and a driven coupler illustrated in FIG. 3 according to an example.
Figure 5:
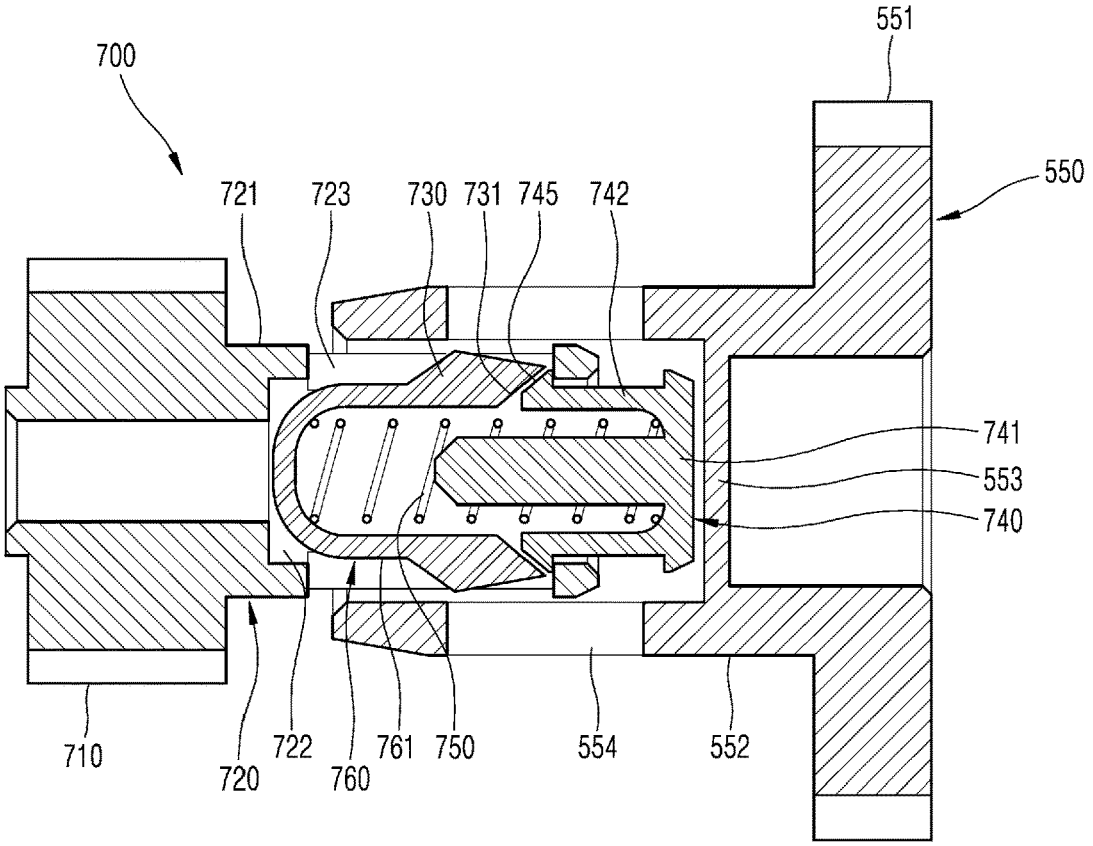
FIG. 5 is a cross-sectional view illustrating a state in which a switching member is located at a second position in the coupling structure illustrated in FIG. 3 according to an example.
Figure 6:
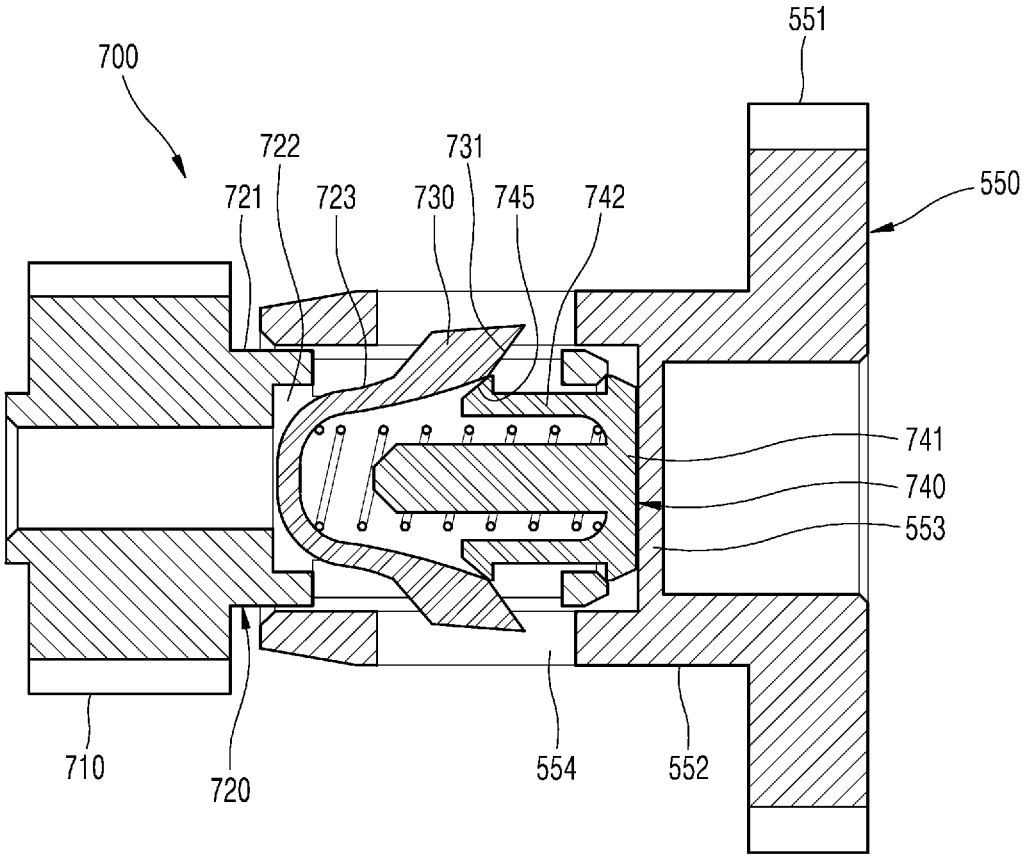
FIG. 6 is a cross-sectional view illustrating a state in which a switching member is located at a first position in the coupling structure illustrated in FIG. 3 according to an example.

FIG. 3 is a perspective view of a coupling structure according to an example. FIG. 4 is a cross-sectional view of a driving coupler and a driven coupler illustrated in FIG. 3 according to an example. FIG. 5 is a cross-sectional view illustrating a state in which a switching member is located at a second position in the coupling structure illustrated in FIG. 3 according to an example. FIG. 6 is a cross-sectional view illustrating a state in which a switching member is located at a first position in the coupling structure illustrated in FIG. 3 according to an example.

Referring to FIGS. 3 to 6, a cartridge 600 may be the toner container (i.e., the toner cartridge) 100, the photosensitive unit (i.e., the photosensitive cartridge) 200, the developing unit (i.e., the development cartridge) 300, or the imaging cartridge 400 in which the photosensitive unit 200 and the developing unit 300 are integrated. The cartridge 600 may include a rotation member and a driven coupler 700 for rotating the rotation member by receiving a rotation force. In an example, the rotation force is received from an external source (e.g., the outside), for example, from a driving coupler 550 provided at the main body 500. The driven coupler 700 may be provided at a side portion 601 of the cartridge 600 in the mounting direction A1. When the cartridge 600 is mounted in the main body 500, the driven coupler 700 may be connected to the driving coupler 550. The driven coupler 700 may include a power transmission member 710, an extension member 720, a protrusion member 730, a switching member 740, and an elastic member 750.

The power transmission member 710 may be connected to the rotation member. The power transmission member 710 may be a power transmission element such as a gear, a pulley, or the like. The extension member 720 may extend from the power transmission member 710. The extension member 720 may have the shape of a hollow cylinder extending in the axial direction from the power transmission member 710. The extension member 720 may include an outer diameter portion 721, a hollow portion 722, and a through portion 723 passing through the hollow portion 722 and the outer diameter portion 721. The outer diameter portion 721 may form the outer circumference of the extension member 720. The through portion 723 may be formed such that the protrusion member 730 may be moved between a protrusion position and a retreat position. Also, the through portion 723 may be formed to receive a rotation force from the protrusion member 730. As an example, the through portion 723 may have the shape of a slot extending in an axial direction B of the extension member 720. In an example, the extension member 720 may be integrally formed with the power transmission member 710.

The protrusion member 730 may be located at the hollow portion 722. The protrusion member 730 may protrude from the outer diameter portion 721 through the through portion 723 to be moved between the protrusion position (see FIG. 6), at which the protrusion member 730 may receive a rotation force, and the retreat position (see FIG. 5), at which the protrusion member 730 does not protrude from the outer diameter portion 721. When the protrusion member 730 is located at the protrusion position, the protrusion member 730 may receive the rotation force of the driving coupler 550 as described below.

The switching member 740 may be inserted into the hollow portion 722 to be movable in the axial direction B of the extension member 720, that is, in the extension direction of the extension member 720. The switching member 740 may move the protrusion member 730 between the protrusion position and the retreat position according to positions in the axial direction B. The switching member 740 may be moved between the first position (see FIG. 6) for locating the protrusion member 730 at the protrusion position and the second position (see FIG. 5) for locating the protrusion member 730 at the retreat position. As described below, the switching member 740 may be moved between the second position and the first position by interfering with the driving coupler 550 when the cartridge 600 is mounted in the main body 500.

The elastic member 750 may apply an elastic force to the switching member 740 in a direction of locating the protrusion member 730 at the retreat position. That is, the elastic member 750 may apply an elastic force to the switching member 740 in the direction of being located at the second position.

As an example, an insertion member 760 including an elastic arm 761 may be inserted into the hollow portion 722. The protrusion member 730 may be provided at an end portion of the elastic arm 761. The protrusion member 730 may be elastically biased by the elastic arm 761 in the direction of being located at the retreat position.

As an example, the switching member 740 may include a pressing portion 741 and an operation arm 742 extending from the pressing portion 741 into the hollow portion 722. A hook 743 may be provided at an end portion of the operation arm 742. An end portion of the through portion 723 may be provided with a catch portion 724 on which the hook 743 may be caught. An end portion of the operation arm 742 may be provided with an operation portion 745 for moving the protrusion member 730 to the protrusion position by pushing the protrusion member 730 in the opposite direction of the elastic force of the elastic arm 761 when the switching member 740 is moved from the second position toward the first position. The protrusion member 730 may be provided with a contact portion 731. As the switching member 740 is moved between the second position and the first position, the operation portion 745 may contact the contact portion 731 and push the contact portion 731. The contact portion 731 and the operation portion 745 may be inclined with respect to the axial direction B. As the elastic arm 761 bends or moves outward, the protrusion member 730 may pass through the through portion 723 to be switched to the protrusion position protruding from the outer diameter portion 721.

As an example, the driven coupler 700 may include a rotation preventing portion for preventing the switching member 740 from being rotated inside the hollow portion 722. The rotation preventing portion may be implemented, for example, by a rotation preventing groove 726 that is formed at the outer diameter portion 721 by being cut in the axial direction B and a rotation preventing protrusion 744 that is provided at the switching member 740 to be inserted into the rotation preventing groove 726.

As an example, the elastic member 750 may be implemented by a compression coil spring that is inserted into the hollow portion 722 such that one end portion and the other end portion thereof are supported by the insertion member 760 and the switching member 740, respectively. Because the hook 743 is caught on the catch portion 724, the switching member 740 may be maintained at the second position despite the elastic force of the elastic member 750 without being deviated from the extension member 720 beyond the second position.

The shape of the driving coupler 550 may vary according to various examples. The driving coupler 550 may include a portion to receive a rotation force from the motor, a portion to interfere with the switching member 740 such that the switching member 740 is moved between the second position and the first position when the cartridge 600 is mounted in the main body 500, and a portion to transmit the rotation force by contacting the protrusion member 730 located at the protrusion position. The driving coupler 550 may include, for example, a gear portion 551 for receiving a rotation force from the motor. A rotation force transmitting portion 552 may extend from the gear portion 551 in the axial direction B. The rotation force transmitting portion 552 may have a hollow cylindrical shape such that the extension member 720 may be inserted thereinto when the cartridge 600 is mounted in the main body 500. The rotation force transmitting portion 552 may include a first interference portion 553 and a second interference portion 554. When the cartridge 600 is mounted in the main body 500, the pressing portion 741 of the switching member 740 located at the second position may contact the first interference portion 553. The second interference portion 554 may circumferentially contact the protrusion member 730 located at the protrusion position.

Through the above configuration, a process of mounting the cartridge 600 in the main body 500 and a process of removing the cartridge 600 from the main body 500 will be described.

In a state in which the cartridge 600 is detached from the main body 500, the switching member 740 may be located at the second position by the elastic force of the elastic member 750. Because the protrusion member 730 is located at the retreat position by the elastic restoring force of the elastic arm 761, the protrusion member 730 may not protrude from the outer diameter portion 721. Thus, a risk that the protrusion member 730 will be damaged by an external impact applied to the protrusion member 730 in the process of handling the cartridge 600 is reduced. As the protrusion amount from the outer diameter portion 721 of the protrusion member 730 increases, because the contact area with the second interference portion 554 may increase, the rotation force may be stably transmitted from the driving coupler 550 to the driven coupler 700. The protrusion amount of the protrusion member 730 may be adjusted by the size of the protrusion member 730, the contact amount between the operation portion 745 of the switching member 740 and the contact portion 731 of the protrusion member 730, or the like. According to an example, because the risk of damage to the protrusion member 730 is reduced when the cartridge 600 is detached from the main body 500, the protrusion member 730 and the switching member 740 may be formed such that the protrusion amount from the outer diameter portion 721 of the protrusion member 730 may be large.

Referring again to FIG. 2, the door 501 may be opened and the cartridge 600 may be pushed and inserted into the main body 500 in the mounting direction A1. The driven coupler 700 provided at the side portion 601 of the cartridge 600 in the mounting direction A1 may approach the driving coupler 550 provided at the main body 500. When the cartridge 600 approaches the mounting position, the extension member 720 may start to be inserted into the rotation force transmitting portion 552. As illustrated in FIG. 5, the pressing portion 741 may contact the first interference portion 553. When the cartridge 600 continues to be inserted in the mounting direction A1 in this state, the switching member 740 may be pushed by the first interference portion 553 to move in the axial direction B.

As the operation portion 745 contacts the contact portion 731 of the protrusion member 730, the elastic arm 761 may be spread outward by the operation portion 745 and the protrusion member 730 may start to protrude from the outer diameter portion 721 through the through portion 723.

When the mounting of the cartridge 600 is completed, the switching member 740 may reach the first position as illustrated in FIG. 6. The elastic arm 761 may be supported by the operation portion 745 to be spread (e.g., maximally spread), and the protrusion member 730 may reach the protrusion position protruding from the outer diameter portion 721. When the driving coupler 550 rotates in this state, the second interference portion 554 may contact the protrusion member 730 and the rotation force of the driving coupler 550 may be transmitted to the protrusion member 730. The protrusion member 730 may push the circumferential edge of the through portion 723. Thus, the extension member 720 and the power transmission member 710 may rotate.

When the cartridge 600 is the toner cartridge 100, the power transmission member 710 may be connected to the rotation member of the toner cartridge 100, for example, the toner discharge member 110 and the paddle members 120 and 130, by a gear train (not illustrated) or the like. When the cartridge 600 is the photosensitive unit 200, the power transmission member 710 may be connected to the rotation member of the photosensitive unit 200, for example, the photosensitive drum 1 and the charging roller 2, by a gear train (not illustrated) or the like. When the cartridge 600 is the developing unit 300, the power transmission member 710 may be connected to the rotation member of the developing unit 300, for example, the developing roller 10 and the first and second agitators 341 and 342, by a gear train (not illustrated). Also, when the cartridge 600 is the imaging cartridge 400, the power transmission member 710 may be connected to the rotation members of the photosensitive unit 200 and the developing unit 300 by a gear train (not illustrated).

When the cartridge 600 is removed from the main body 500, the door 501 may be opened and the cartridge 600 may be pulled in the removal direction A2. As the cartridge 600 is moved in the removal direction A2, the switching member 740 may be returned from the first position to the second position by the elastic force of the elastic member 750 and the protrusion member 730 may be returned from the protrusion position to the retreat position by the elastic force of the elastic arm 761.

By this configuration, it may be possible to reduce the risk of damage to the rotation force transmission element of the driven coupler 700, for example, the protrusion member 730 receiving a rotation force from the driving coupler 550, when the cartridge 600 is detached from the main body 500. Also, it may be possible to implement the driven coupler 700 capable of being miniaturized while stably transmitting the rotation force and reducing the risk of damage by external impact.

Figure 7:
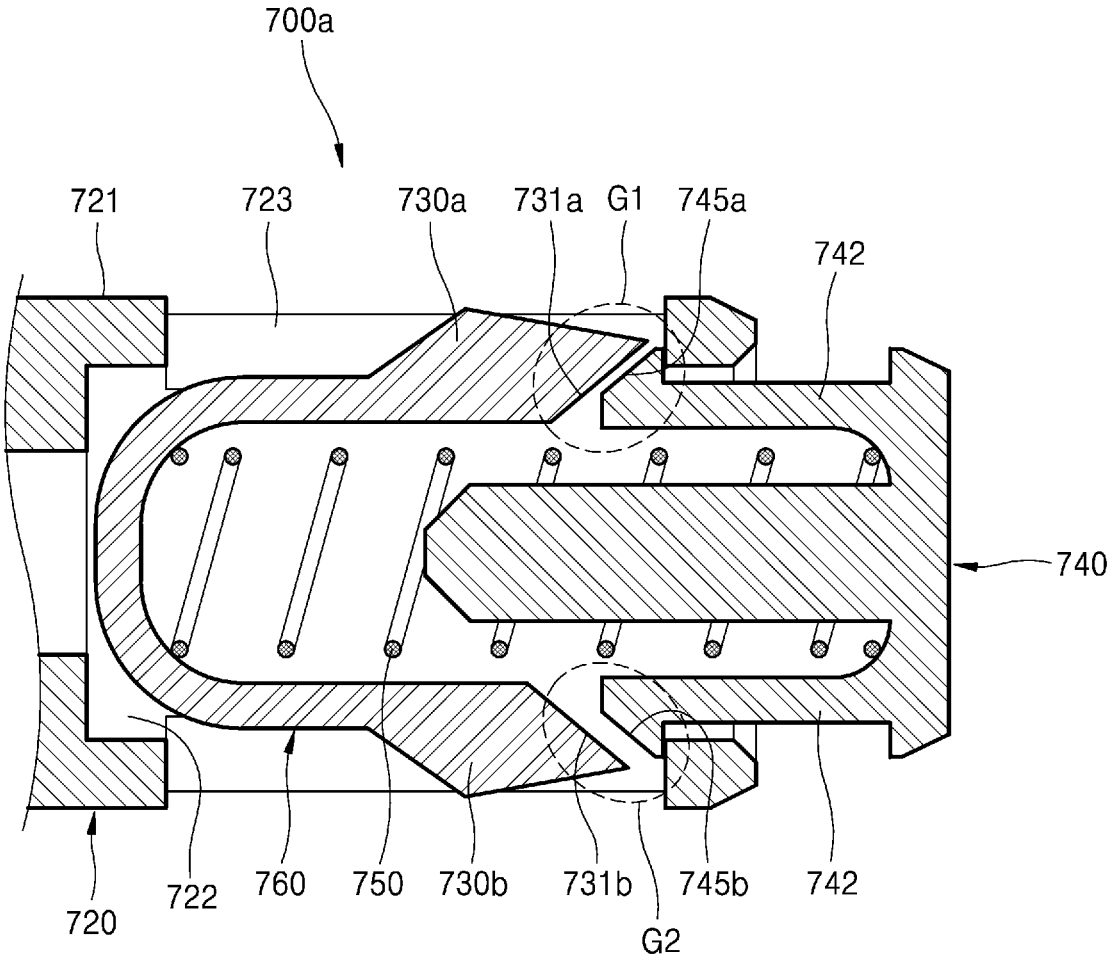
FIG. 7 is a cross-sectional view of a driven coupler according to an example.

FIG. 7 is a cross-sectional view of a driven coupler according to an example.

Referring to FIG. 7, a driven coupler **700*a* may include a plurality of protrusion members 730*a* and 730*b*. The protrusion member 730*a* may be a reference protrusion member, and the protrusion member 730*b* may be a sub protrusion member. The switching member 740 may move the reference protrusion member 730*a* to the protrusion position before the sub protrusion member 730*b*** when moved from the second position to the first position.

As an example, the switching member 740 may include a reference operation portion **745*a* interfering with the reference protrusion member 730*a* to move the reference protrusion member 730*a* to the protrusion position. The switching member 740 may also include a sub operation portion 745***b* interfering with the sub protrusion member 730*b* to move the sub protrusion member 730*b* to the protrusion position. When the switching member 740 is located at the second position as illustrated in FIG. 7, a gap G1 between the reference operation portion 745*a* and the reference protrusion member 730*a* may be less than a gap G2 between the sub operation portion 745*b* and the sub protrusion member 730*b*. According to this configuration, when the switching member 740 moves from the second position to the first position, the reference operation portion 745*a* may contact a contact portion 731*a* of the reference protrusion member 730*a* and the reference protrusion member 730*a* may start to move toward the protrusion position first. Thereafter, the sub operation portion 745*b* may contact a contact portion 731*b* of the sub protrusion member 730*b* and the sub protrusion member 730*b* may start to move toward the protrusion position.

Figure 8A:
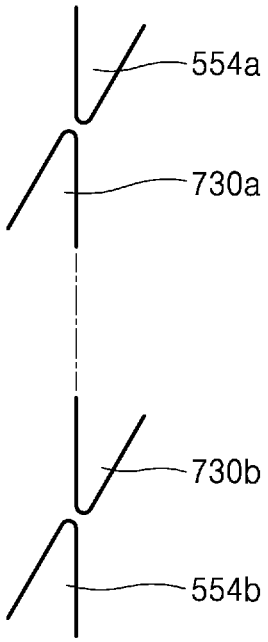
FIGS. 8A and 8B are diagrams illustrating an operation of the driven coupler illustrated in FIG. 7 according to an example.
Figure 8B:
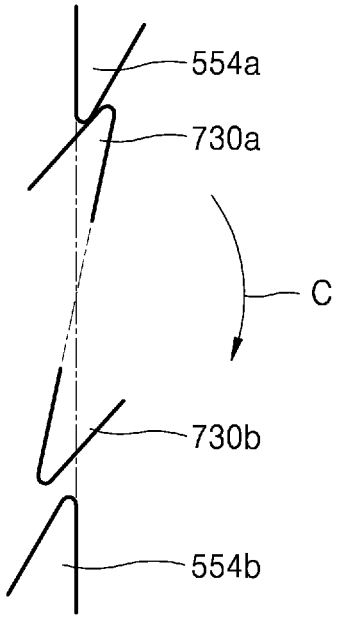

FIGS. 8A and 8B are diagrams illustrating an operation of the driven coupler illustrated in FIG. 7 according to an example.

Referring to FIG. 8A, according to a structure in which the reference protrusion member 730*a* and the sub protrusion member 730*b* are simultaneously moved to the protrusion position, the reference protrusion member 730*a* and the sub protrusion member 730*b* may be accurately aligned in a radial direction with second interference portions 554*a* and 554*b* of the driving coupler 550 corresponding thereto. In this case, the outer edges of the reference protrusion member 730*a* and the sub protrusion member 730*b* may simultaneously contact the edges of the second interference portions 554*a* and 554*b* of the driving coupler 550. When the cartridge 600 is pushed in the mounting direction A1 in this state, the reference protrusion member 730*a* and the sub protrusion member 730*b* may be fitted like a wedge between the switching member 740 and the second interference portions 554*a* and 554*b* of the driving coupler 550. In this case, the cartridge 600 may be in a state of being unable to reach the mounting position or to slide in the mounting direction A1 any further.

According to an example, the reference protrusion member 730*a* may start to move toward the protrusion position first. Even when the reference protrusion member 730*a* and the sub protrusion member 730*b* are accurately aligned in the radial direction with the second interference portions 554*a* and 554*b* of the driving coupler 550 corresponding thereto as illustrated in FIG. 8A, the edge of the reference protrusion member 730*a* and the edge of the second interference portion 554*a* of the driving coupler 550 corresponding thereto may contact each other first as illustrated in FIG. 8B. The edge of the sub protrusion member 730*b* and the edge of the second interference portion 554*b* of the driving coupler 550 corresponding thereto may be in a state of being spaced apart from each other. Thus, the driven coupler 700 may be in a rotatable state. The width of the reference protrusion member 730*a* may decrease as it extends. The width of the second interference portion 554*a* may also decrease as it extends. When the edge of the reference protrusion member 730*a* and the edge of the second interference portion 554*a* of the driving coupler 550 corresponding thereto contact each other, the driven coupler 700 may rotate slightly as indicated by a reference numeral "C" in FIG. 8B and thus the edge of the reference protrusion member 730*a* and the edge of the second interference portion 554*a* of the driving coupler 550 corresponding thereto may be misaligned with each other. Simultaneously, the edge of the sub protrusion member 730*b* and the edge of the second interference portion 554*b* of the driving coupler 550 corresponding thereto may also be misaligned with each other. Thus, the reference protrusion member 730*a* and the sub protrusion member 730*b* may naturally move to the protrusion position. The width of the sub protrusion member 730*b* may decrease as it extends. The width of the second interference portion 554*b* may also decrease as it extends.

There may be three or more protrusion members 730. In this case, any one of the three or more protrusion members 730 may be the reference protrusion member 730*a* and the others may be the sub protrusion members 730*b*.

Figure 9:
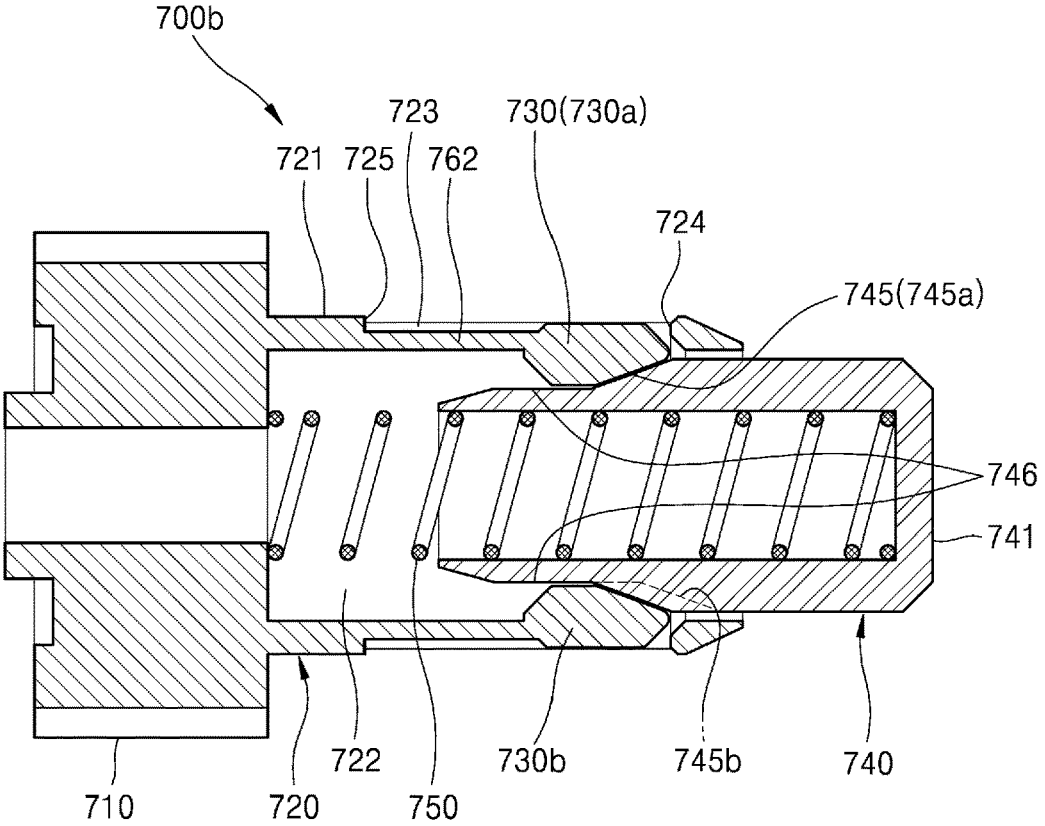
FIGS. 9 and 10 are cross-sectional views of a driven coupler, respectively illustrating a state in which a protrusion member is located at a retreat position and a state in which the protrusion member is located at a protrusion position according to an example.
Figure 10:
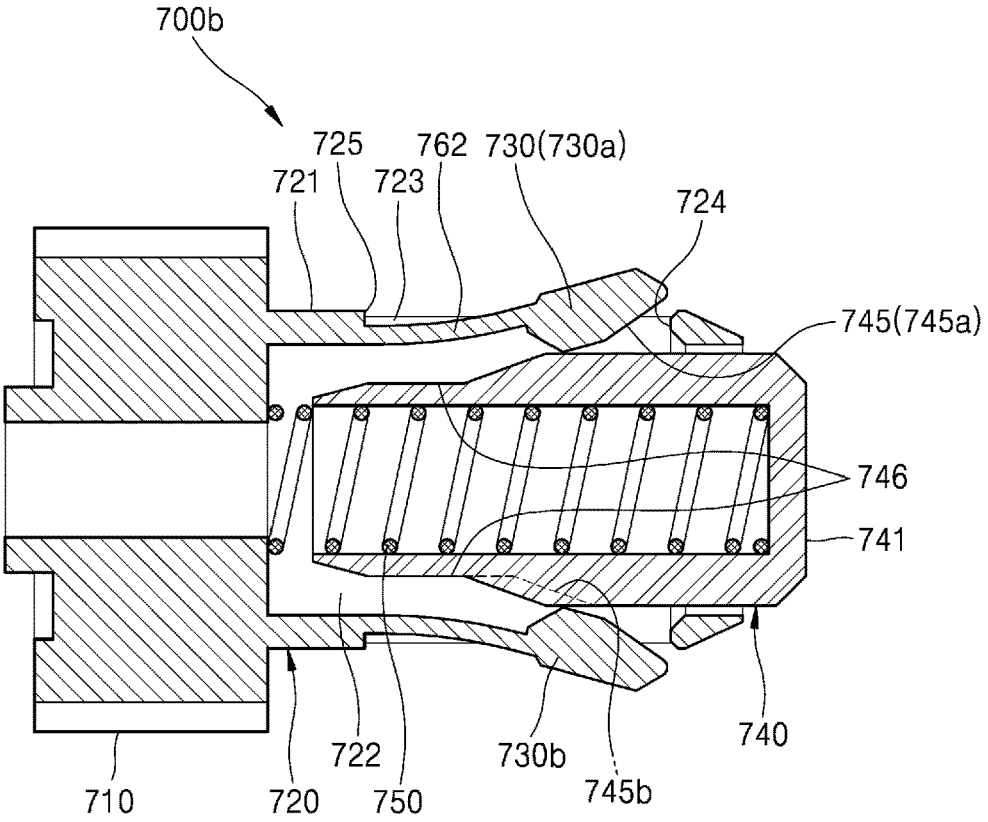

FIGS. 9 and 10 are cross-sectional views of a driven coupler, respectively illustrating a state in which a protrusion member is located at a retreat position and a state in which the protrusion member is located at a protrusion position according to an example.

Referring to FIGS. 9 and 10, a driven coupler 700*b* may be different from the driven coupler 700 illustrated in FIG. 3 in that the protrusion member 730 may be integrally formed with the extension member 720. Hereinafter, various differences between the driven coupler 700*b* and the driven coupler 700 will be mainly described.

As illustrated in FIGS. 9 and 10, an elastic arm 762 may extend from one end portion 725 of the through portion 723 toward the other end portion 724 thereof. The protrusion member 730 may be provided at the elastic arm 762. The protrusion member 730 may be elastically biased by the elastic arm 762 in the direction of being located at the retreat position.

When the switching member 740 is located at the first position, the protrusion member 730 may be pushed in the opposite direction of the elastic force of the elastic arm 762 to be located at the protrusion position. The switching member 740 may include an operation portion 745 and a support portion 746. When the switching member 740 moves from the second position to the first position, the operation portion 745 may push the protrusion member 730 to move the protrusion member 730 to the protrusion position. The support portion 746 may be sunken radially from the operation portion 745 to allow the protrusion member 730 to be returned to the retreat position by the elastic force of the elastic arm 762 when the switching member 740 moves from the first position to the second position. The protrusion member 730 may be supported by the support portion 746 at the retreat position.

According to the driven coupler 700*b* described above, the insertion member 760 may be omitted in comparison with the driven coupler 700. The structure of the driven coupler 700*a* illustrated in FIG. 7 may also be applied to the driven coupler 700*b* illustrated in FIGS. 9 and 10. For example, as illustrated in FIG. 9, the driven coupler 700*b* may include a reference protrusion member 730*a* and a sub protrusion member 730*b*. The switching member 740 may include a reference operation portion 745*a* interfering with the reference protrusion member 730*a* to move the reference protrusion member 730*a* to the protrusion position. The switching member 740 may also include a sub operation portion 745*b* (indicated by a dashed line in FIG. 9) interfering with the sub protrusion member 730*b* to move the sub protrusion member 730*b* to the protrusion position. When the switching member 740 is located at the second position as illustrated in FIG. 9, a gap between the reference operation portion 745*a* and the reference protrusion member 730*a* may be less than a gap between the sub operation portion 745*b* and the sub protrusion member 730*b*. According to this configuration, when the switching member 740 moves from the second position to the first position, the reference operation portion 745*a* may contact a contact portion 731*a* of the reference protrusion member 730*a* and the reference protrusion member 730*a* may start to move toward the protrusion position first. Thereafter, the sub operation portion 745*b* may contact a contact portion 731*b* of the sub protrusion member 730*b* and the sub protrusion member 730*b* may start to move toward the protrusion position.

Figure 11:
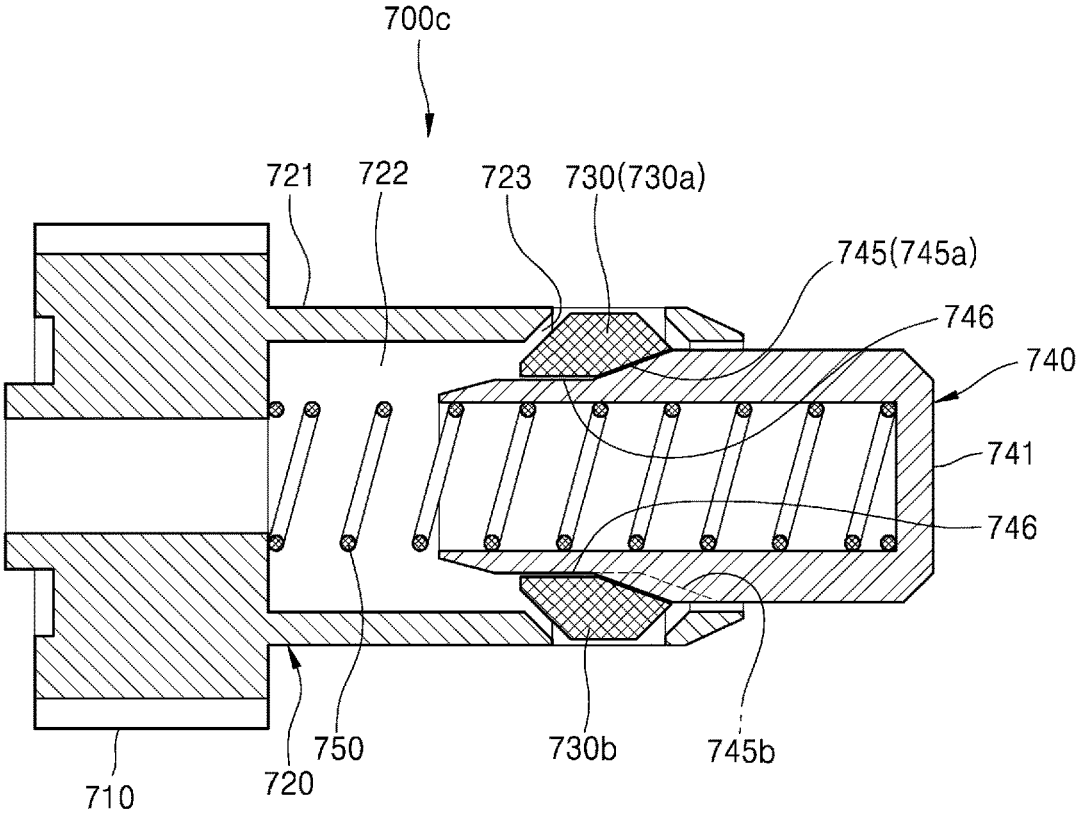
FIGS. 11 and 12 are cross-sectional views of a driven coupler, respectively illustrating a state in which a protrusion member is located at a retreat position and a state in which the protrusion member is located at a protrusion position according to an example.
Figure 12:
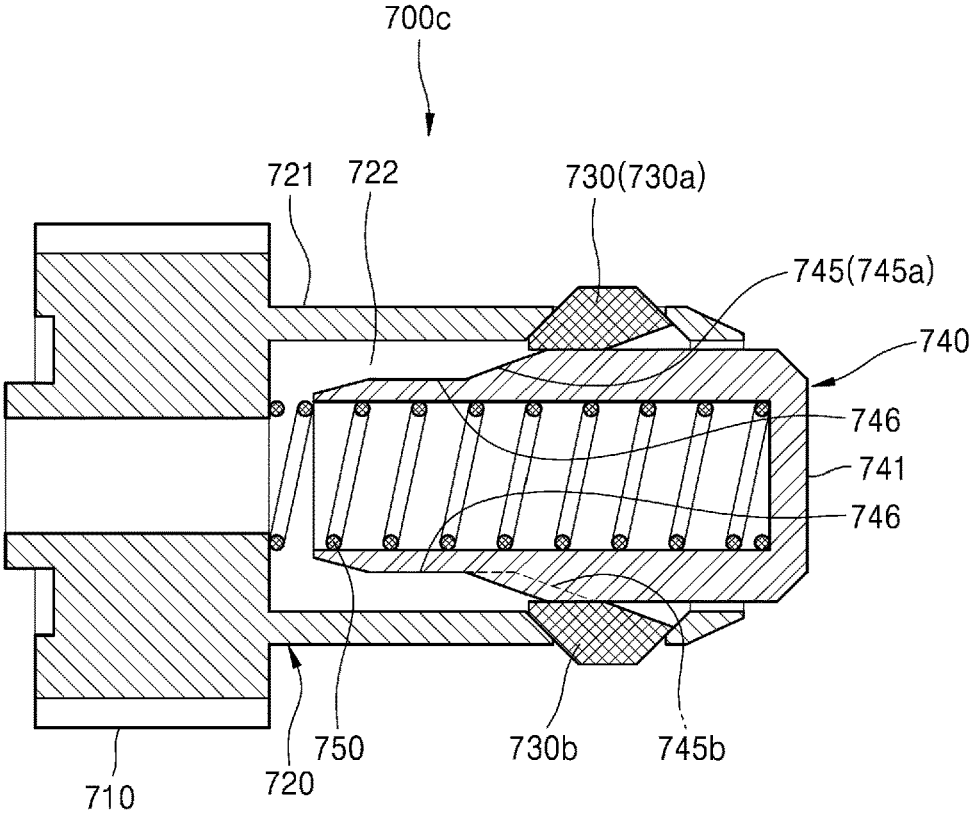

FIGS. 11 and 12 are cross-sectional views of a driven coupler, respectively illustrating a state in which a protrusion member is located at a retreat position and a state in which the protrusion member is located at a protrusion position according to an example.

A driven coupler 700*c* of the present example may be different from the driven coupler 700*b* illustrated in FIGS. 9 and 10 in that the elastic arm 762 is omitted and the protrusion member 730 is supported between the extension member 720 and the switching member 740. Hereinafter, various differences between the driven coupler 700*c* and the driven coupler 700*b* will be mainly described.

Referring to FIGS. 11 and 12, the protrusion member 730 may be partially inserted into the through portion 723. The protrusion member 730 may be supported by the switching member 740. The length of the through portion 723 in the axial direction B may gradually decrease toward an outside such that the protrusion member 730 may not be deviated from the extension member 720 through the through portion 723. The switching member 740 may include an operation portion 745 for pushing the protrusion member 730 to locate the protrusion member 730 at the protrusion position when it is located at the first position. The switching member 740 may also include a support portion 746 for allowing the protrusion member 730 to return to the retreat position when it is located at the second position. The support portion 746 may be formed to be sunken radially from the operation portion 745.

According to the driven coupler 700*c* described above, in comparison with the driven coupler 700 and the driven coupler 700*b*, the insertion member 760 may be omitted and the structure of the extension member 720 may be simplified. The structure of the driven coupler 700*a* illustrated in FIG. 7 may also be applied to the driven coupler 700*c* illustrated in FIGS. 11 and 12. For example, as illustrated in FIG. 11, the driven coupler 700*c* may include a reference protrusion member 730*a* and a sub protrusion member 730*b*. The switching member 740 may include a reference operation portion 745*a* interfering with the reference protrusion member 730*a* to move the protrusion member 730*a* to the protrusion position. The switching member 740 may also include a sub operation portion 745*b* (indicated by a dashed line in FIG. 11) interfering with the sub protrusion member 730*b* to move the sub protrusion member 730*b* to the protrusion position. When the switching member 740 is located at the second position as illustrated in FIG. 11, a gap between the reference operation portion 745*a* and the reference protrusion member 730*a* may be less than a gap between the sub operation portion 745*b* and the sub protrusion member 730*b*. According to this configuration, when the switching member 740 moves from the second position to the first position, the reference operation portion 745*a* may contact a contact portion 731*a* of the reference protrusion member 730*a* and the reference protrusion member 730*a* may start to move toward the protrusion position first. Thereafter, the sub operation portion 745*b* may contact a contact portion 731*b* of the sub protrusion member 730*b* and the sub protrusion member 730*b* may start to move toward the protrusion position.

Figure 13:
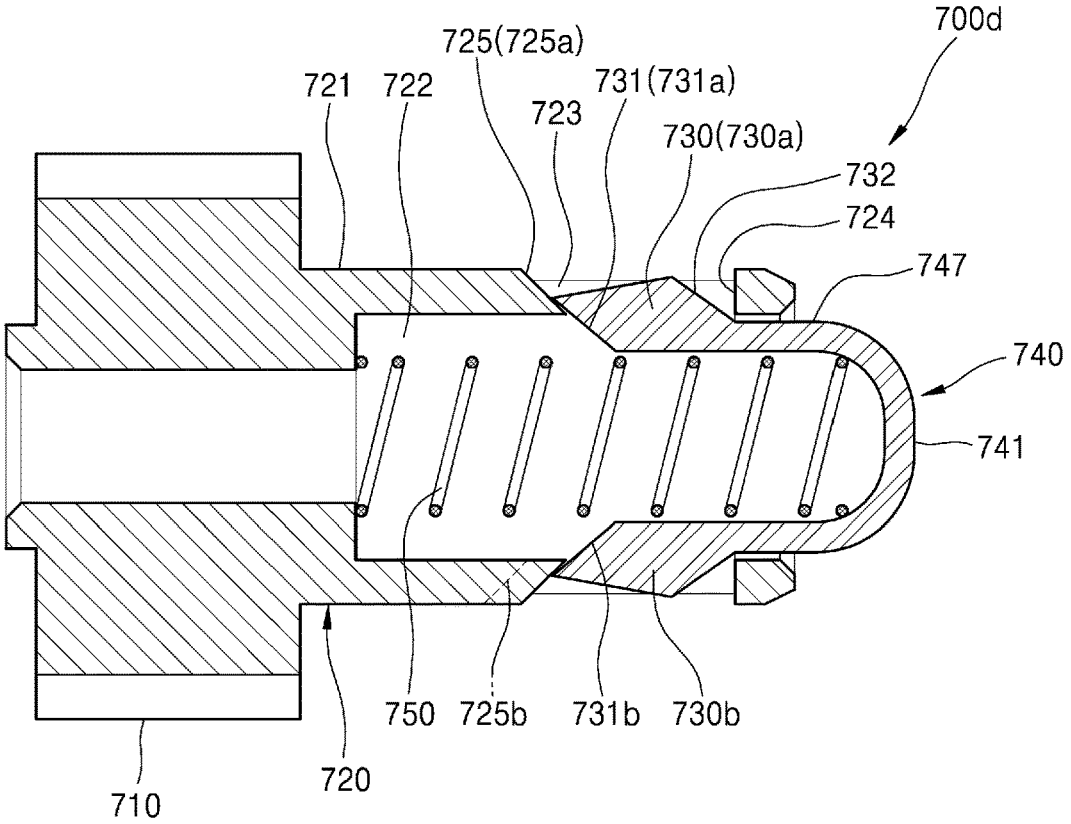
FIGS. 13 and 14 are cross-sectional views of a driven coupler, respectively illustrating a state in which a protrusion member is located at a retreat position and a state in which the protrusion member is located at a protrusion position according to an example.
Figure 14:
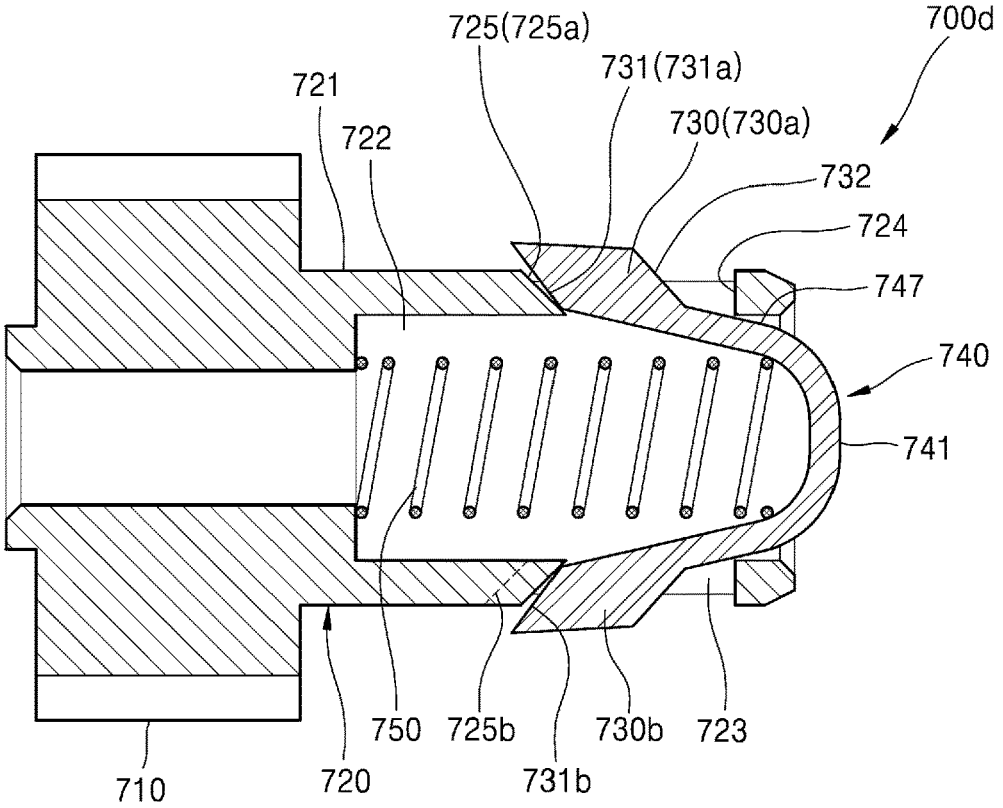

FIGS. 13 and 14 are cross-sectional views of a driven coupler, respectively illustrating a state in which a protrusion member is located at a retreat position and a state in which the protrusion member is located at a protrusion position according to an example.

The driven coupler 700*d* of the present example may be different from the driven coupler 700 illustrated in FIG. 3 in that the protrusion member 730 may be integrally formed with the switching member 740. Hereinafter, various differences between the driven coupler 700*d* and the driven coupler 700 will be mainly described.

Referring to FIGS. 13 and 14, the switching member 740 may be provided with an elastic arm 747. The elastic arm 747 may extend from the pressing portion 741 into the hollow portion 722. The protrusion member 730 may be provided at an end portion of the elastic arm 747. The protrusion member 730 may be elastically biased by the elastic arm 747 in the direction of being located at the retreat position. An end portion 725 of the through portion 723 may function as an operation portion for guiding the protrusion member 730 to the protrusion position when the switching member 740 moves from the second position to the first position. Hereinafter, the end portion 725 will be referred to as an operation portion 725. The operation portion 725 and the contact portion 731 of the protrusion member 730 may contact each other and may be inclined such that the elastic arm 747 may be naturally spread outward. An opposite portion 732 of the contact portion 731 of the protrusion member 730 may be caught on a catch portion 724 provided at an end portion of the through portion 723. Thus, the switching member 740 may be maintained at the second position despite the elastic force of the elastic member 750 without being deviated from the extension member 720.

By this configuration, when the switching member 740 moves from the second position to the first position, the contact portion 731 may be guided to the operation portion 725. As the elastic arm 747 spreads outward, the protrusion member 730 may pass through the through portion 723 to move to the protrusion position protruding from the outer diameter portion 721. When the switching member 740 moves between the first position and the second position, the elastic arm 747 may be elastically restored and the protrusion member 730 may return to the retreat position.

According to the driven coupler 700*d* described above, the insertion member 760 may be omitted in comparison with the driven coupler 700. The structure of the driven coupler 700*a* illustrated in FIG. 7 may also be applied to the driven coupler 700*d* illustrated in FIGS. 13 and 14. For example, as illustrated in FIG. 13, the driven coupler 700*d* may include a reference protrusion member 730*a* and a sub protrusion member 730*b*. The through portion 723 may be provided with a reference operation portion 725*a* interfering with the reference protrusion member 730*a* to move the protrusion member 730*a* to the protrusion position. The through portion 723 may also be provide with a sub operation portion 725*b* (indicated by a dashed line in FIG. 13) interfering with the sub protrusion member 730*b* to move the sub protrusion member 730*b* to the protrusion position. When the switching member 740 is located at the second position as illustrated in FIG. 13, a gap between the reference operation portion 725*a* and the reference protrusion member 730*a*, that is, a gap between the reference operation portion 725*a* and the contact portion 731*a*, may be less than a gap between the sub operation portion 725*b* and the sub protrusion member 730*b*. According to this configuration, when the switching member 740 moves from the second position to the first position, the reference operation portion

725*a* may contact the contact portion 731*a* of the reference protrusion member 730*a* and the reference protrusion member 730*a* may start to move toward the protrusion position first. Thereafter, the sub operation portion 725*b* may contact the contact portion 731*b* of the sub protrusion member 730*b* and the sub protrusion member 730*b* may start to move toward the protrusion position.

It should be understood that examples described herein should be considered in a descriptive sense only and not for purposes of limitation. Descriptions of features or aspects within each example should typically be considered as available for other similar features or aspects in other examples. While one or more example has been described with reference to the figures, it will be understood by those of ordinary skill in the art that various changes in form and details may be made therein without departing from the spirit and scope as defined by the following claims.

What is claimed is:

1. A cartridge comprising:

a rotation member; and a driven coupler to receive a rotation force to rotate the rotation member, wherein the driven coupler comprises:

a power transmission member connected to the rotation member;

an extension member extending from the power transmission member and comprising an outer diameter portion, a hollow portion, and a through portion passing through the hollow portion and the outer diameter portion;

a protrusion member located at the hollow portion to be movable between a protrusion position protruding from the outer diameter portion through the through portion for receiving the rotation force and a retreat position not protruding from the outer diameter portion;

a switching member inserted into the hollow portion to be movable in an axial direction of the extension member to move the protrusion member between the protrusion position and the retreat position according to positions in the axial direction; and an elastic member to apply an elastic force to the switching member in a direction of locating the protrusion member at the retreat position.

2. The cartridge of claim 1, further comprising an insertion member inserted into the hollow portion and comprising an elastic arm, wherein the protrusion member is provided at an end portion of the elastic arm to be elastically biased in a direction of being located at the retreat position, and wherein the switching member locates the protrusion member at the protrusion position by pushing the protrusion member in an opposite direction of an elastic force of the elastic arm when moved between a second position for locating the protrusion member at the retreat position and a first position for locating the protrusion member at the protrusion position.

3. The cartridge of claim 1, wherein the protrusion member is integrally formed with the extension member.

4. The cartridge of claim 3, further comprising an elastic arm extending from one end portion toward another end portion of the through portion, wherein the protrusion member is provided at the elastic arm to be elastically biased in a direction of being located at the retreat position, and wherein the switching member locates the protrusion member at the protrusion position by pushing the protrusion member in an opposite direction of an elastic force of the elastic arm when moved between a second position for locating the protrusion member at the retreat position and a first position for locating the protrusion member at the protrusion position.

5. The cartridge of claim 1, wherein the protrusion member is partially inserted into the through portion and supported between the extension member and the switching member, and wherein the switching member comprises an operation portion to push the protrusion member to the protrusion position when moved between a second position for locating the protrusion member at the retreat position and a first position for locating the protrusion member at the protrusion position and a support portion allowing the protrusion member to return to the retreat position when located at the second position.

6. The cartridge of claim 1, wherein the protrusion member is integrally formed with the switching member.

7. The cartridge of claim 6, further comprising an elastic arm provided at the switching member, wherein the protrusion member is provided at an end portion of the elastic arm to be elastically biased in a direction of being located at the retreat position, and wherein an end portion of the through portion is provided with an operation portion to guide the protrusion member to the protrusion position when the switching member moves between a second position for locating the protrusion member at the retreat position and a first position for locating the protrusion member at the protrusion position.

8. The cartridge of claim 7, wherein the through portion is provided with a catch portion on which the protrusion member is caught such that the switching member is not deviated from the extension member beyond the second position.

9. The cartridge of claim 1, wherein the protrusion member comprises a reference protrusion member and a sub protrusion member, and wherein the switching member locates the reference protrusion member at the protrusion position before the sub protrusion member when moved between a second position for locating the protrusion member at the retreat position and a first position for locating the protrusion member at the protrusion position.

10. The cartridge of claim 9, wherein the switching member comprises a reference operation portion to interfere with the reference protrusion member to move the reference protrusion member between the protrusion position and a sub operation portion to interfere with the sub protrusion member to move the sub protrusion member to the protrusion position, and wherein a gap between the reference protrusion member and the reference operation portion is less than a gap between the sub protrusion member and the sub operation portion when the switching member is located at the second position.

11. The cartridge of claim 9, wherein a width of the reference protrusion member decreases as it extends.

12. The cartridge of claim 1, wherein the rotation member comprises at least one of a conveying member to convey toner to a toner outlet, a photosensitive drum on which an electrostatic latent image may be formed, or a developing roller to supply a toner to the photosensitive drum.

13. A toner cartridge comprising:

a toner container to contain a toner;

a conveying member to convey the toner of the toner container to a toner outlet; and a driven coupler to receive a rotation force to rotate the conveying member, wherein the driven coupler comprises:

a power transmission member connected to the conveying member;

an extension member extending from the power transmission member and comprising an outer diameter portion, a hollow portion, and a through portion passing through the hollow portion and the outer diameter portion;

a protrusion member located at the hollow portion to be movable between a protrusion position protruding from the outer diameter portion through the through portion for receiving the rotation force and a retreat position not protruding from the outer diameter portion;

a switching member inserted into the hollow portion to be movable in an axial direction of the extension member to move the protrusion member to the protrusion position and the retreat position according to positions in the axial direction; and an elastic member to apply an elastic force to the switching member in a direction of locating the protrusion member at the retreat position.

14. The toner cartridge of claim 13, further comprising an insertion member inserted into the hollow portion and comprising an elastic arm, wherein the protrusion member is provided at an end portion of the elastic arm to be elastically biased in a direction of being located at the retreat position, and wherein the switching member comprises an operation portion locating the protrusion member at the protrusion position by pushing the protrusion member in an opposite direction of an elastic force of the elastic arm when moved from a second position for locating the protrusion member at the retreat position to a first position for locating the protrusion member at the protrusion position.

15. The toner cartridge of claim 14, wherein the protrusion member comprises a reference protrusion member and a sub protrusion member, wherein the operation portion comprises a reference operation portion to interfere with the reference protrusion member to move the reference protrusion member to the protrusion position and a sub operation portion to interfere with the sub protrusion member to move the sub protrusion member to the protrusion position, and wherein a gap between the reference protrusion member and the reference operation portion is less than a gap between the sub protrusion member and the sub operation portion when the switching member is located at the second position.

* * * * *